US009993864B2

(12) United States Patent
Segaud et al.

(10) Patent No.: US 9,993,864 B2
(45) Date of Patent: Jun. 12, 2018

(54) METHOD FOR PRODUCING A CASTING CORE FOR MANUFACTURING CYLINDER HEADS

(71) Applicant: Bayerische Motoren Werke Aktiengesellschaft, Munich (DE)

(72) Inventors: Jean-Marc Segaud, Landshut (DE); Manfred Huber, Rottenburg (DE); Thomas Summer, Hohenthann (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days. days.

(21) Appl. No.: 15/160,333

(22) Filed: May 20, 2016

(65) Prior Publication Data

US 2016/0263647 A1 Sep. 15, 2016

Related U.S. Application Data

(63) Continuation of application No. PCT/EP2015/052682, filed on Feb. 10, 2015.

(30) Foreign Application Priority Data

Feb. 28, 2014 (DE) ..... 10 2014 203 699

(51) Int. Cl.
*B22C 9/10* (2006.01)
*B22C 9/08* (2006.01)
(Continued)

(52) U.S. Cl.
CPC ..... *B22C 9/103* (2013.01); *B22C 9/02* (2013.01); *B22C 9/082* (2013.01); *B22C 9/10* (2013.01);
(Continued)

(58) Field of Classification Search
CPC .. B22C 9/02; B22C 9/082; B22C 9/10; B22C 9/103; B22C 9/108; B22C 9/22; B22D 15/02; B22D 25/02
(Continued)

(56) References Cited

U.S. PATENT DOCUMENTS 4,273,182 A 6/1981 Winterhalter et al.
4,609,030 A 9/1986 Heater et al.
(Continued)

FOREIGN PATENT DOCUMENTS

CN 1128966 A 8/1996
CN 2253679 Y 5/1997
(Continued)

OTHER PUBLICATIONS

EPO machine translation of CN 101817060 A (Year: 2010).*
(Continued)

*Primary Examiner* — Kevin E Yoon
(74) *Attorney, Agent, or Firm* — Crowell & Moring LLP

(57) ABSTRACT

A method for producing a casting core for manufacturing cylinder heads including the following steps: producing at least one core component, by a constructive method, with a contour for the formation of internal contours of a first cylinder head producing at least one further core component, by a constructive method, with a contour for the formation of internal contours of a further cylinder head; producing at least one sprue core component for feeding the molten mass during the casting method; and joining the two core components to the sprue core component in an opposing orientation.

10 Claims, 5 Drawing Sheets

(51) Int. Cl.

| | |
|---|---|
| ***B22C 9/22*** | (2006.01) |
| ***B22C 9/02*** | (2006.01) |
| ***B22D 15/02*** | (2006.01) |
| ***B22D 25/02*** | (2006.01) |

(52) U.S. Cl.
CPC ..... *B22C 9/108* (2013.01); *B22C 9/22* (2013.01); *B22D 15/02* (2013.01); *B22D 25/02* (2013.01)

(58) Field of Classification Search
USPC ..... 164/24, 28, 137, 369
See application file for complete search history.

(56) References Cited

U.S. PATENT DOCUMENTS

| | | | | |
|---|---|---|---|---|
| 5,119,881 | A | 6/1992 | Cagle | |
| 6,147,138 | A | 11/2000 | Hoechsmann et al. | |
| 6,155,331 | A | 12/2000 | Langer et al. | |
| 6,533,020 | B2 * | 3/2003 | Shade | B22C 9/103 164/11 |
| 7,413,001 | B2 * | 8/2008 | Wang | B22C 9/10 164/361 |
| 2005/0072551 | A1 * | 4/2005 | Sorokin | B22C 21/00 164/137 |
| 2008/0092386 | A1 | 4/2008 | Hildebrand et al. | |
| 2011/0277721 | A1 | 11/2011 | Baker et al. | |

FOREIGN PATENT DOCUMENTS

| | | | |
|---|---|---|---|
| CN | 101817060 | A | 9/2010 |
| CN | 102251873 | A | 11/2011 |
| CN | 103212669 | A | 7/2013 |
| DE | 195 35 487 | C1 | 8/1996 |
| DE | 690 29 572 | T2 | 4/1997 |
| DE | 197 23 892 | C1 | 9/1998 |
| DE | 100 59 083 | C1 | 1/2002 |
| EP | 0 933 151 | A1 | 8/1999 |
| EP | 0 968 776 | A1 | 1/2000 |
| WO | WO 2006/072400 | A1 | 7/2006 |

OTHER PUBLICATIONS

Chinese Office Action issued in counterpart Chinese Application No. 201580002952.X dated Dec. 29, 2016 with English translation (19 pages).

International Search Report (PCT/ISA/210) issued in PCT Application No. PCT/EP2015/052682 dated Jun. 18, 2015 with English translation (seven pages).

German-language Written Opinion (PCT/ISA/237) issued in PCT Application No. PCT/EP2015/052682 dated Jun. 18, 2015 (six pages).

German Search Report issued in German Application No. 19 2014 203 699.2 dated Dec. 17, 2014 with partial English translation (12 pages).

* cited by examiner

METHOD FOR PRODUCING A CASTING CORE FOR MANUFACTURING CYLINDER HEADS

CROSS REFERENCE TO RELATED APPLICATIONS

This application is a continuation of PCT international Application No. PCT/EP2015/052682, filed Feb. 10, 2015, which claims priority under 35 U.S.C. § 119 from German Patent Application No. 10 2014 203 699.2, filed Feb. 28, 2014, the entire disclosures of which are herein expressly incorporated by reference.

BACKGROUND AND SUMMARY OF THE INVENTION

The present invention relates to a method for producing a casting core for manufacturing cylinder heads, to a casting core for manufacturing cylinder heads and to a casting method for manufacturing at least two cylinder heads.

It is known for cylinder heads to be produced by casting. For this purpose, an appropriate outer contour is formed in slides, or in particular in a base plate, usually in a mold. In order for it to be possible to form appropriate inner contours such as water channels, air channels and the combustion chambers in the cylinder head, so-called "lost cores" are used in the mold for casting purposes. These lost cores are usually formed from sand and serve to keep the corresponding cavities free from the penetration of the molten melt material. In the case of known molds, the cylinder heads are oriented from top to bottom, and therefore the melt, penetrating from above at a high melting temperature, comes into direct contact with the base plate and is distributed there. This results in the base plate, and the contours provided there for forming the corresponding mating contour of the cylinder head, being subjected to a high level of thermal loading.

In addition to the thermal loading and the maintenance which is correspondingly necessary for the base plate, known casting methods have further disadvantages, in particular the limitation in design freedom relating to the cylinder heads. It is thus still necessary, in the case of this alignment from top to bottom, for the demolding capability to be ensured. This also applies precisely in the case of lost cores. Furthermore, it is also still necessary, for the tasks of inserting and producing these lost cores in the form of casting cores, to ensure corresponding production capability. These two limitations reduce the design freedom and thus also the possibility of generating complex cylinder-head shapes. Not least, the production of the casting cores themselves is a high-outlay and costly method. It is also the case that the task of orienting and positioning the same in the mold is very time-consuming.

It is an object of the present invention to overcome the above described disadvantages at least in part. In particular it is an object of the present invention to improve production of the casting cores and/or the cylinder heads in a cost-effective and simple manner.

The object indicated above is achieved by a method for producing a casting core, by a casting core itself and by a casting method according to embodiments of the invention. It is, of course, also the case here that features and details which are described in conjunction with the method according to the invention also apply in conjunction with the casting core according to the invention and with the casting method according to the invention, and vice versa, and therefore as far as the disclosure relating to the individual aspects of the invention is concerned, reference is always, or can always, be made to the other subjects of the invention in each case.

A method according to the invention serves for producing a casting core for manufacturing cylinder heads. For this purpose, the method has the following steps:

- generating at least one core component, using a constructive method, with a contour for forming inner contours of a first cylinder head;
- generating at least one further core component, using a constructive method, with a contour for forming inner contours of a further cylinder head;
- generating at least one sprue core component, for supplying the melt during casting; and
- connecting the two core components to the sprue core component in opposite orientations.

A method according to the invention, then, uses individual core components to construct a casting core. In particular at least two core components are generated, each for forming the inner contours of a cylinder head. It is thus possible according to the invention to use a casting core produced according to the invention to produce two cylinder heads simultaneously in a mold. It is already evident here that the production capacity using a mold, over the same period of time, is thus doubled or essentially doubled.

It is likewise evident that the same doubling of the production of the cylinder heads can likewise take place by way of a single casting core and, accordingly, with the production outlay and the production period required for a single casting core.

A "constructive method" within the context of the present invention is, in particular, so-called rapid prototyping or so-called 3D printing. The respectively desired geometrically three-dimensional shape of the corresponding core component is constructed here in layers. It is possible here according to the invention for a wide variety of different types of connections to be provided between the individual layers. It is preferred if this connection between the individual layers is sufficiently strong to provide the necessary resistance when the melt is introduced. At the same time, it is necessary to be able to ensure easy release for the material of the casting core for demolding purposes so that, in the end, the correspondingly produced cylinder head can also be used.

It is, of course, also possible for the core components and/or the sprue core component to be generated, at least in part, together in a single step. It is thus contemplated for one of the core components to be provided directly with the functionalities of the sprue core component. Of course, it is also possible for the two core components to include part of sprue core component and, accordingly, for a casting core according to the invention to be produced by these being joined together.

Connecting the two core components to the sprue core component in opposite orientations is to be understood to mean that the two cylinder heads are then likewise produced in opposite orientations within the mold. Whereas, in the case of known molds, it is usually the case that the cylinder heads have their combustion chambers oriented downward in the direction of the base plate, an orientation in which the cylinder heads are rotated through 90° can now be made possible by a casting core according to the invention. As a result, the two cylinder heads have their combustion chambers oriented in the direction of the lateral slides in the mold. The combustion chambers of the two cylinder heads here are oriented in opposite directions to one another. As seen in a side view, this means that one of the two cylinder heads is oriented to the left and the other cylinder head is oriented to the right. As is clearly evident here, it is no longer necessary for the contours to be formed, with high outlay, in the base plate; rather, they are provided in the lateral slides of the molds. This results in a considerable reduction in the thermal loading to which the base plate is subjected during casting.

In addition to a longer service life for the base plate, it is thus also possible to reduce by a considerable extent the time and costs required for maintaining the base plate or changing over the same. In addition to the process-related advantages in respect of the base plate not being adversely affected and the installation having a higher capacity, production of the casting core according to the invention can also ensure a higher level of design freedom for the geometrical design of cylinder heads. Thus, the lateral orientation of the two core components allows a higher level of design freedom in respect of the inner contours and thus also of the closed-off, or partially closed-off, volumes within the cylinder head. Not least, a great advantage of the casting core according to the invention is the reduction in the amount of material required for the core. The fact that the sprue core is now used for two cylinder heads avoids a second sprue core component in comparison with a known solution for producing a single cylinder head. In other words, the sprue core component used according to the invention is used for feeding the mold for two cylinder heads in parallel. This results in a reduction in the amount of material being used for the casting core. Since it is also the case, at the same time, that less feed material is necessary, it is also possible here to cut back on costs, time and, in particular, on the amount of material required.

It may be advantageous if, in the case of a method according to the invention, the sprue core component is likewise generated by a constructive method. The constructive method, here too, is to be understood to mean so-called 3D printing or rapid prototyping. In particular, the same method and/or the same material composition is used here for the sprue core component as for at least one of the two other core components. It is, of course, preferred if the same material and the same constructive method are used for all the core components and for the sprue core component. This can achieve a considerable reduction in the complexity of the method as a whole and thus in the costs thereof.

A method according to the invention can be developed to the extent where the core components have a connecting portion, in particular a form-fitting portion, and the sprue core component has mating connecting portions, in particular mating form-fitting portions. This allows the core components to be fastened, via the connecting portions, on the mating connecting portions of the sprue core component. It is preferred if the solutions here are form-fitting and force-fitting transmitting ones. This means that the core components and the sprue core component can be simply plugged one inside the other. It is thus possible, for example, for the connecting interface of the core component to have a corresponding pin-like protrusion. The associated mating connecting portion of the sprue core component has a corresponding depression, and therefore assembly takes place by the core component being simply plugged into the associated mating connecting portion of the sprue core component. This arrangement is designed, in particular, such that the connecting portions and the mating connecting portions are uniquely oriented in relation to one another in geometrical terms. It should be understood here that unique orientation of the respective core component is possible only at a single location, and in a single position, on the mating connecting portion. This avoids, with a high level of probability, the risk of incorrect assembly and therefore of an incorrect geometry for the cylinder heads which are to be produced. Not least, it is possible for the connecting portions and the mating connecting portion, in addition to providing for the straightforward form-fitting and/or force-fitting connection, also to constitute a centering aid or a positioning aid. This also results in the required tolerances being achieved with a higher level of probability and particularly with a higher level of reliability. Assembly as a whole and also the positioning operation are thus possible not just more easily, but also more quickly.

A further advantage can be achieved if, in the case of a method according to the invention, the core components are connected to the sprue core component in opposite orientations of approximately 180°. This orientation is to be understood, in particular, to mean an angle of orientation which forms between the two main directions of orientation of the two cylinder heads or of the two associated core components. It is thus possible, for example, for the extrusion axis of a corresponding combustion chamber of the cylinder head to provide for such an orientation. It is preferred if the angle between the axis of the combustion chamber of one of the two cylinder heads and the axis of the combustion chamber of the further cylinder head is approximately 180°. This results in the necessary cavity space within a mold being utilized as efficiently as possible. This allows the associated mold to be designed to be smaller, more compact and to cut back on the amount of material required.

A further advantage can be achieved if, in the case of a method according to the invention, the sprue core component has at least one feeder portion and, in particular, at least one air-outlet portion. It should be understood here that melt can be correspondingly introduced via the feeder portion. Here too, it is clearly evident that only a single feeder portion, or a single number of feeder portions, is necessary for two cylinder heads. Since the melt also solidifies in the feeder portion, this inevitably results in waste during casting, and this, accordingly, can be halved, in comparison with known solutions, as a result of the design and double use here for two cylinder heads. Accordingly, the same also applies to the air-outlet portion, which is used to let out the air located in the cavity during the operation of the melt being introduced. Here too, it is correspondingly possible to cut back on the amount of material required.

It is also advantageous if, in the case of a method according to the invention, an inorganic material is used for producing at least one of the core components. This results, in particular, in advantages for the production of the casting core, and also at a later stage for the removal or insertion of the casting core. This relates, in particular, to possibly arising harmful substances or odorous substances, which may be unpleasant or even hazardous. Accordingly, the use of inorganic material is already preferred for the production of the casting core.

The present invention likewise relates to a casting core for manufacturing cylinder heads, having at least two core components generated using a constructive method, with a contour for forming inner contours of a respective cylinder head. The casting core also has a sprue core component for supplying the melt during casting. The core components here are connected to the sprue core component in opposite orientations. A casting core is preferably produced by a method according to the invention. A casting core according to the invention is therefore accompanied by the same advantages as have been explained in detail in relation to the method according to the invention. Attention should be drawn, in particular, to the possible types of connection between the core components and the sprue core component, as have been explained in detail in relation to the connecting portions or the form-fitting portions and the associated mating connecting portions.

The present invention further relates to a casting method for manufacturing at least two cylinder heads, having the following steps:

- supplying a casting core having the features of the present invention;
- inserting the casting core into a mold with the two core components oriented laterally for forming at least two cylinder heads;
- closing the mold; and
- introducing the melt through feeder channels, formed by the sprue core component of the casting core.

A method according to the invention utilizes, in particular, a casting core which has been produced by a method according to the invention. A casting method according to the invention is therefore accompanied by the same advantages as have been explained in detail in relation to a method according to the invention and in relation to a casting core according to the invention.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
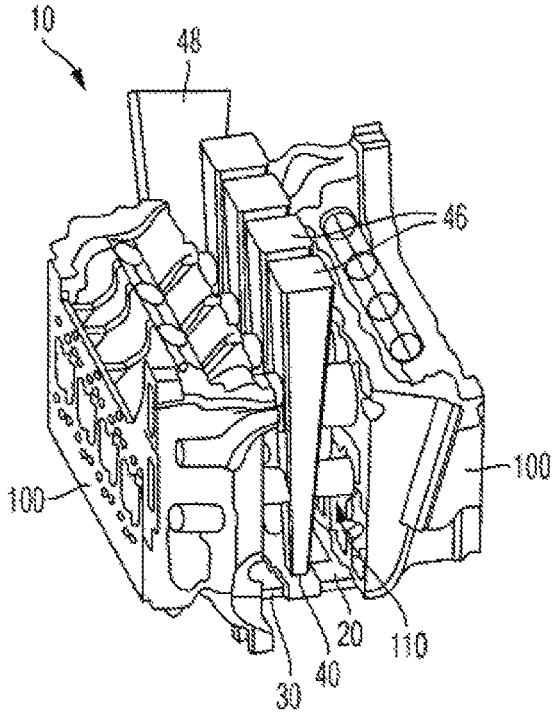
FIG. 1 shows a first embodiment of a casting core according to the invention and of associated cylinder heads.
Figure 2:
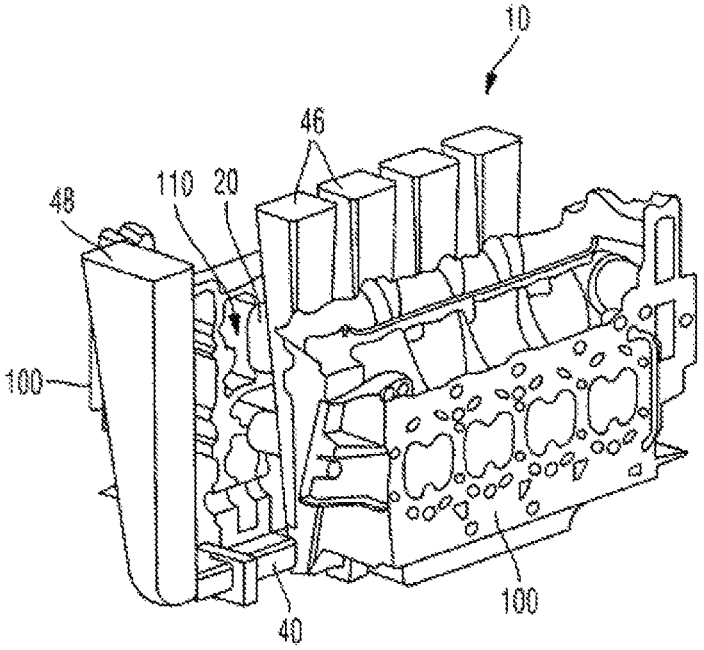
FIG. 2 shows the embodiment of FIG. 1 from a different perspective.

FIGS. 1 and 2 show, in schematic form, how a casting core 10 according to the invention works. It is clearly evident here how a central sprue core component 40 has a further core component 20 and 30 arranged on the left and right of it in each case. The two lateral core components 20 and 30 here have corresponding contours, which serve for forming the respective cylinder head 100 and the associated inner contour 110. It is also clearly evident here how the central sprue core component 40 and the corresponding feeder portions 46 and the air-outlet portion 48 provide central, and thus double-use, functions for the two cylinder heads 100.

Figure 3:
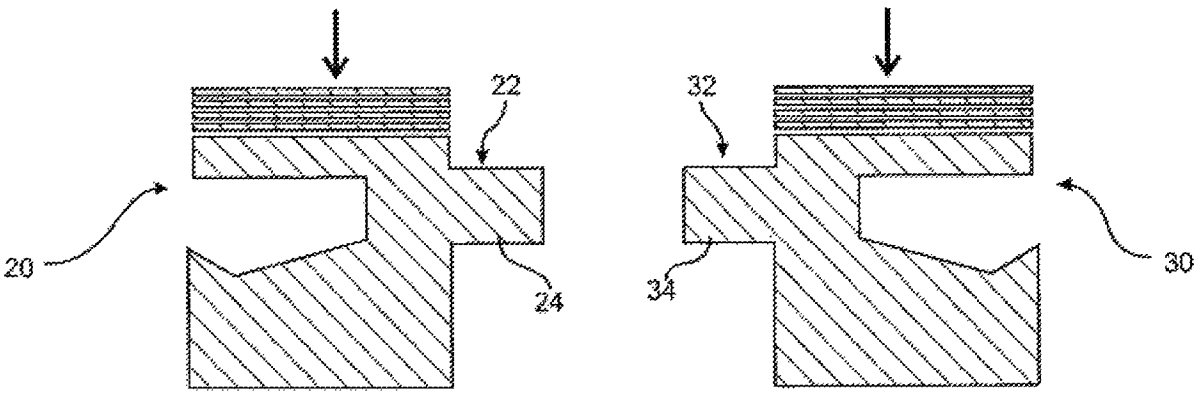
FIG. 3 shows the constructive method step for producing a casting core according to the invention.

FIG. 3 shows, in schematic form, a first step of a method according to the invention. Here, preferably inorganic material is constructed in layers for example with the aid of rapid prototyping or 3D printing. In the case of this embodiment, two core components 20 and 30 are constructed. It is already clearly evident here that the two core components 20 and 30 are of symmetrical design, since they are used for configuring the same or identical cylinder heads 100. The formation of pin-like extensions for the connecting portions 22 and 32 is also clearly evident in this illustration. The two connecting portions 22 and 32 are designed here in the form of form-fitting portions 24 and 34.

Figure 4:
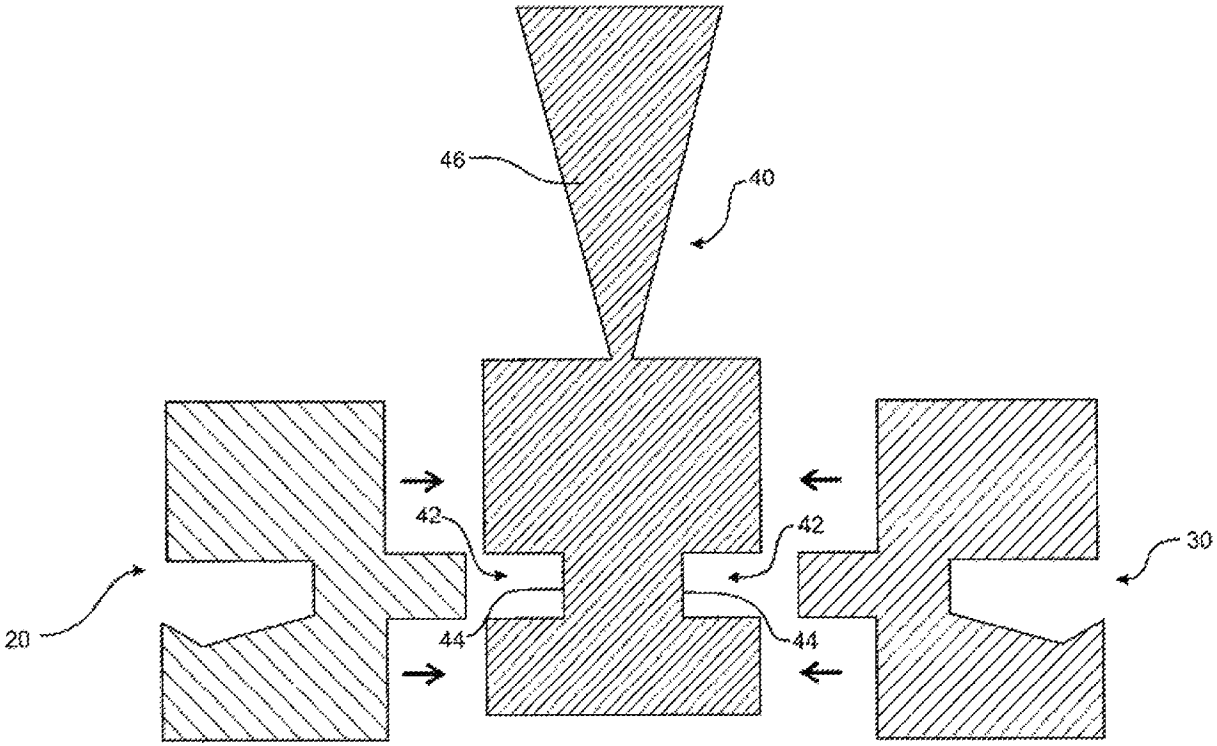
FIG. 4 shows the step of connecting the core components to a sprue core component.

FIG. 4 shows the operation of assembling the resulting core components 20 and 30 and a sprue core component 40. The sprue core component 40 may likewise have been generated here, for example, in layers. The arrows illustrate clearly here how the two core components 20 and 30 are simply pushed laterally into corresponding mating connecting portions 42. Connections to the connecting portions 22 and 32 can thus be ensured via the correlation of the mating connecting portions 42 and/or the design in the form of mating form-fitting portions 44. As a result, following assembly, the appearance of the completed casting core 10 is, for example, like that of the embodiment according to FIG. 5.

Figure 5:
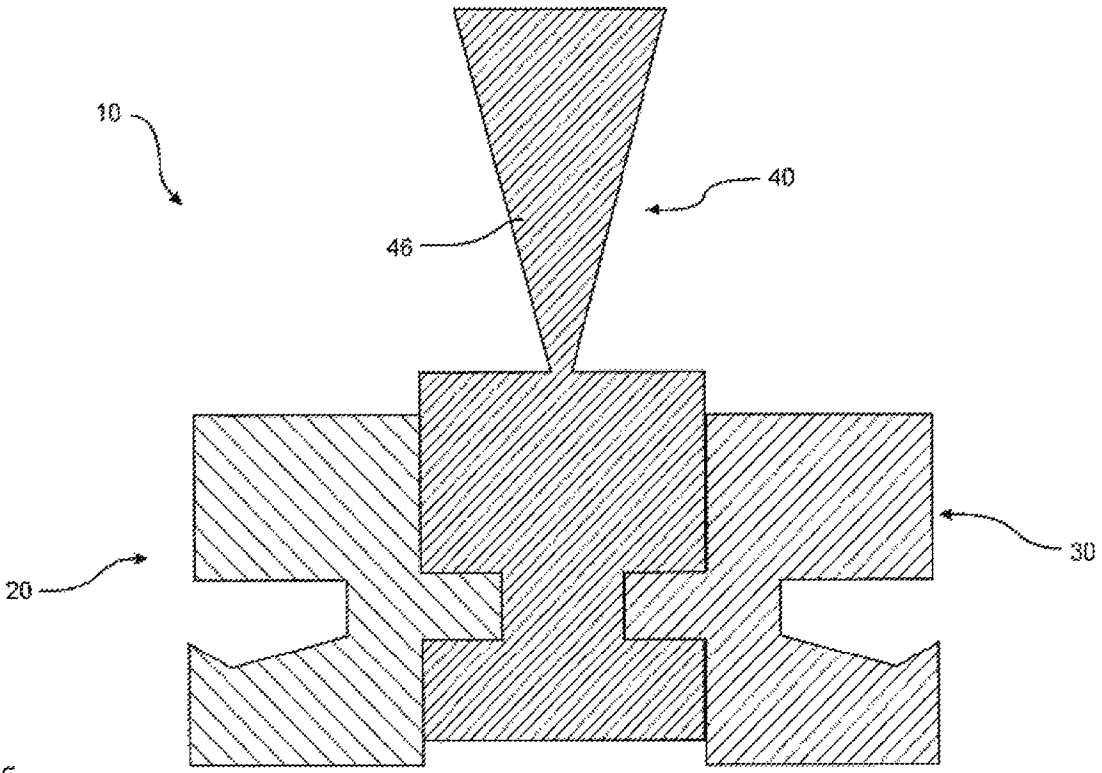
FIG. 5 shows an embodiment of a casting core according to the invention.
Figure 6:
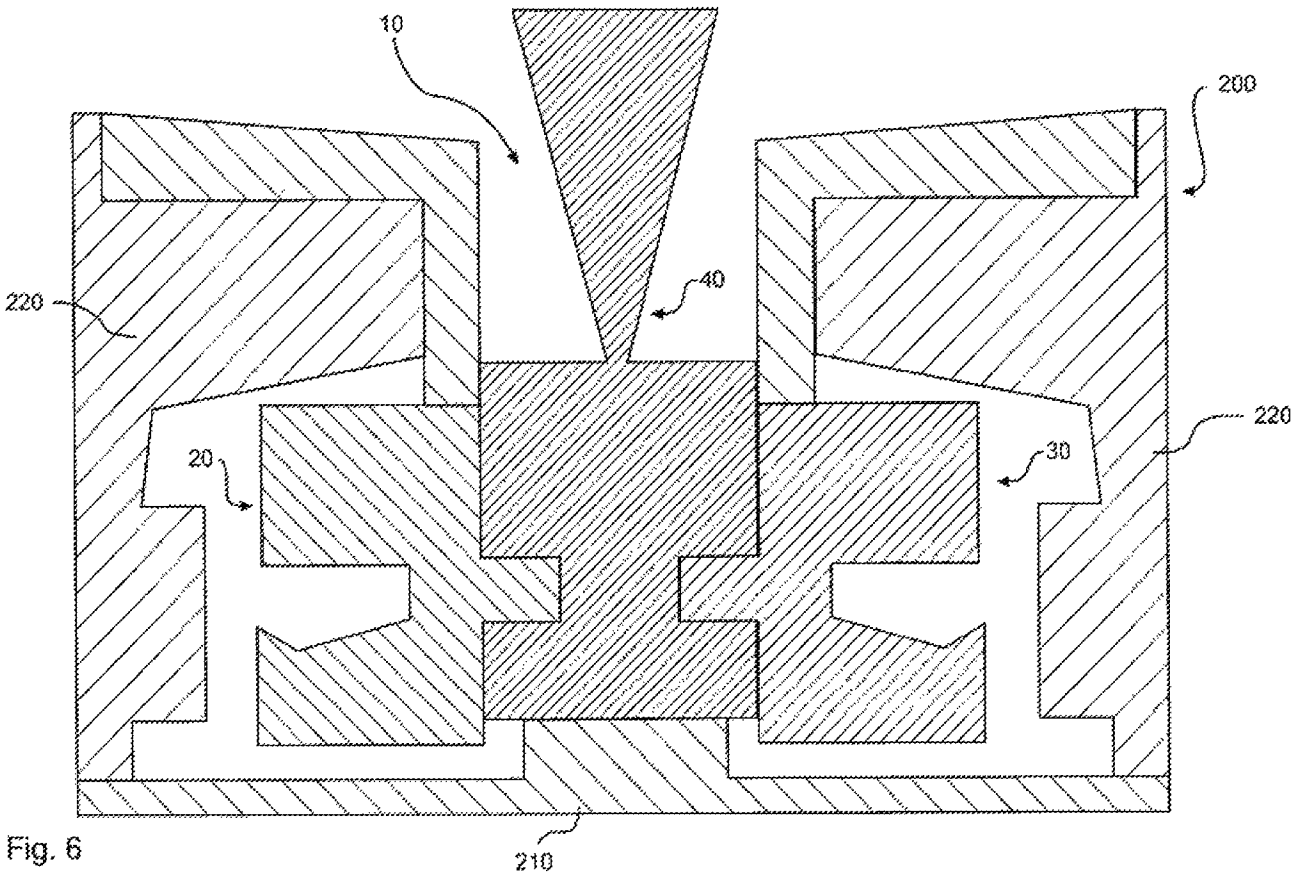
FIG. 6 shows an embodiment of a casting core according to the invention inserted into an appropriate mold.

If the casting core 10 of the embodiment of FIG. 5 is then inserted into a mold 200, the resulting formation may be that, for example, according to FIG. 6. It is clearly evident here that abase plate 210 and lateral slides 220 provide a corresponding cavity, in which spaces for the formation of free volumes in the cylinder heads 100 are kept free above the casting core 10. It is then possible for the casting operation to be carried out according to the invention, and for two cylinder heads 100 to be formed simultaneously in a lateral orientation, offset through 180°, to the left and right of the sprue core component 40.

LIST OF DESIGNATIONS

10 Casting core
20 Core component
22 Connecting portion
24 Form-fitting portion
30 Core component
32 Connecting portion
34 Form-fitting portion
40 Sprue core component
42 Mating connecting portion
44 Mating form-fitting portion
46 Feeder portion
48 Air-outlet portion
100 Cylinder head
110 Inner contour
200 Mold
210 Base plate
220 Slide The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for producing a casting core for manufacturing cylinder heads, the method comprising the acts of:

generating at least one core component, using a constructive method, with a contour for forming inner contours of a first cylinder head;

generating at least one further core component, using a constructive method, with a contour for forming inner contours of a further cylinder head;

generating at least one sprue core component, for supplying the melt during casting; and connecting the two core components to the sprue core component in opposite orientations in a lateral direction such that combustion chambers of the first and further cylinder heads are oriented in laterally opposite directions to one another.

2. The method according to claim 1, wherein the sprue core component is generated by a constructive method.

3. The method according to claim 1, wherein the core components have a connecting portion, and the sprue core component has mating connecting portions, and the core components are fastened, via the connecting portions, on the mating connecting portions of the sprue core component.

4. The method according to claim 3, wherein the connecting portions of the core components are form-fitting portions, and the mating connecting portions of the sprue core component are mating form-fitting portions.

5. The method according to claim 3, wherein the connecting portion of the core components includes a pin-type protrusion, and the mating connecting portions of the sprue core component include a corresponding depression into which the pin-type protrusion is plugged.

6. The method according to claim 1, wherein the core components are connected to the sprue core component in opposite orientations of approximately 180°.

7. The method according to claim 1, wherein the sprue core component has at least one feeder portion.

8. The method according to claim 7, wherein the sprue core component has at least one air-outlet portion.

9. The method according to claim 1, wherein inorganic material is used for generating at least one of the core components.

10. The method according to claim 1, wherein the lateral direction forms an angle of 90° relative to a downward direction to a base plate of a mold.

* * * * *